United States Patent [19]

Wallick

[11] 4,248,662

[45] Feb. 3, 1981

[54] OXYGEN PULPING WITH RECYCLED LIQUOR

[75] Inventor: Scott A. Wallick, Middletown, Ohio

[73] Assignee: The Black Clawson Company, Middletown, Ohio

[21] Appl. No.: 5,354

[22] Filed: Jan. 22, 1979

[51] Int. Cl.[3] ..... D21C 3/02

[52] U.S. Cl. ..... 162/19; 162/25; 162/32; 162/29; 162/38; 162/40; 162/65; 162/80

[58] Field of Search ..... 162/65, 25, 19, 29, 162/41, 45, 38, 80, 32, 40

[56] References Cited

U.S. PATENT DOCUMENTS

| | | | |
|---|---|---|---|
| 3,215,588 | 11/1965 | Kleinert | 162/19 |
| 3,313,677 | 4/1967 | Carr | 162/19 |
| 3,691,008 | 9/1973 | Worster | 162/65 |
| 3,759,783 | 9/1973 | Samuelson et al. | 162/65 |
| 4,045,279 | 8/1977 | Nagano | 162/65 |
| 4,089,737 | 5/1978 | Nagano et al. | 162/65 |
| 4,116,759 | 3/1978 | Janson | 162/65 |

FOREIGN PATENT DOCUMENTS 982759 2/1976 Canada .

OTHER PUBLICATIONS

Markham, Canadian Pulp & Paper Assoc., vol. 4, #4, Dec. 78, pp. 110–114.

Paper Trade Journal, Jul. 15–31, 1978, pp. 37–39.

Marton et al., Empire State Pulp Research Assoc., Report No. 60, Chapter IV, Mar. 15, 1974.

*Primary Examiner*—William F. Smith

*Attorney, Agent, or Firm*—Biebel, French & Nauman

[57] ABSTRACT

Fibrous material is pre-steamed, impregnated with alkali liquor, refined, and then oxygen pulped at a low consistency (about 3 to 8 percent solids) using an alkali liquor which contains boron compounds. The pulping step of the process is carried out in stages with recycle of liquor to preceding stages after it has been reoxygenated. By recycling a major portion of the pulping liquor, the actual liquor to fibrous material ratio at each stage of the pulping step is maintained at a relatively high level (12/1 to 30/1) while the effective liquor to fibrous material ratio for the overall process is much lower (4/1 to 8/1). This results in a bright pulp of acceptable strength as well as a high solids content spent liquor which is economically recoverable.

10 Claims, 2 Drawing Figures

OXYGEN PULPING WITH RECYCLED LIQUOR

BACKGROUND OF THE INVENTION

In the past, conventional processes for pulping fibrous raw materials utilized sulfur-containing compounds. Such compounds were used because of their excellent lignin removing activity. However, waste and spent liquors from such processes caused water and air pollution problems, primarily due to the presence of such sulfur-containing compounds. Accordingly, attempts have been made to accomplish pulping using mechanical or chemical processes, or a combination of the two, without resorting to the use of sulfur-containing compounds.

For example, Worster et al, U.S. Pat. No. 3,691,008, discloses a two-stage pulping process wherein wood chips are subjected to a mild digestion process using sodium hydroxide, mechanically refined, and then subjected to a second pulping-digestion process in the presence of sodium hydroxide and oxygen. Others have substituted various other alkalis for sodium hydroxide such as sodium carbonate, sodium bicarbonate, ammonia, sodium tetraborate, sodium benzoate, magnesium oxide, magnesium hydroxide, and magnesium carbonate.

Thus, Nagano et al, U.S. Pat. No. 4,045,279, uses sodium carbonate and bicarbonate in a pulping process which pre-cooks wood fibers in an aqueous alkaline solution, defibrates the material, and then delignifies the defibrated material in the presence of oxygen and a solution of sodium carbonate and bicarbonate. Canadian Pat. No. 982,759, utilizes a process quite similar to Nagano et al in pre-treating wood fibers with an aqueous solution of alkali, defibrating the material by refining, and pulping the defibrated material in the presence of oxygen and alkali. Finally, Markham, "Use of Borax in Oxygen Pulping", given at the Canadian Pulp and Paper Association Technical Section annual meeting Feb. 1, 1978, noted several advantages of using sodium tetraborate (borax) over sodium carbonate in a single stage oxygen pulping process. Others have discovered that use of high ionic strength borate compounds in oxygen pulping processes increases both delignification rates and pulping selectivity (i.e., yield at a given lignin content).

However, none of the above-mentioned prior art has addressed the problem of obtaining high quality pulp from an oxygen pulping process and simultaneously obtaining a spent liquor which is economically recoverable. It has been found that refining and delignification of high consistency fibrous material (i.e., having a liquor to wood ratio of 4/1 to 6/1) results in pulp having poor qualities such as low strength and brightness. By using a low consistency fibrous material (i.e., having a liquor to wood ratio of 12/1 to 30/1), a more homogeneously delignified pulp is obtained with good strength and brightness properties. Still, use of low consistency fibrous material in refining and oxygen pulping has heretofore been uneconomical because of the high cost of recovery of such dilute spent liquor. In addition, Marton, Empire State Pulp Research Association Report No. 60, Mar. 15, 1974, proposed to oxygen delignify low consistency fibrous material with sodium hydroxide containing liquor and recycle that liquor to the pulping stage of the process, but determined that such recycling was not feasible because of poor quality pulp obtained from such a process. Marton used only a 20% strength sodium hydroxide liquor.

More recently, Nagano et al, U.S. Pat. No. 4,089,737 suggests using a relatively low consistency (liquor to wood ratio of from 5/1 to 20/1) pulp in carrying out an oxidative delignification of pulped material as a first stage of a bleaching process with recycle of liquor. A similar disclosure is found in "Oxygen Bleaching: Low-Consistency Oxygen Delignification System Uses Continuous Pipeline Reactor," *Paper Trade Journal*, July 15–31, 1978, pp. 37–39. However, there is no teaching of a method to obtain simultaneously pulp of high strength properties and an economically recoverable spent liquor while performing the majority of the delignification in the oxygen stage rather than in a prior delignification stage. Accordingly, the need exists in the art for an economical oxygen delignification process which yields high quality pulp.

SUMMARY OF THE INVENTION

Fibrous raw materials such as wood chips and untreated fibrous agricultural materials such as bagasse, straw, and flax are pulped using an oxygen delignification process in which the alkaline liquor utilized in the delignification step of the process is continuously recycled to various stages in the digester. The fibrous raw material is initially subjected to a pre-steaming treatment to soften the material and to remove any trapped air. After pre-steaming, the material optionally can be impregnated with an alkali material which contains boron compounds such as $Na_3BO_3$, $H_3BO_3$, $Na_2B_4O_7.10H_2O$, $Na_2B_4O_7.5H_2O$, $Na_2HBO_3.NaOH$, or $NaH_2BO_3.NaOH$ or combinations of these alkali materials at dosages of from 3 to 150 percent alkali based on the initial weight of the dry fibrous material. During impregnation, the fibrous material is treated with these alkali materials at elevated temperatures, optionally in the presence of oxygen, the partial pressure of oxygen being varied depending upon the material being treated.

After the impregnation step, the material is defiberized using either a single or double disk pressurized refiner or other suitable means. Oxygen-containing gas may be optionally present at this stage. Following the refining step, the defibrated material, which is approximately 20–30 percent solids, is passed into a digestion vessel which may contain multiple stages. Once in the vessel, the consistency of the material is immediately lowered to 3–8 percent solids content by a continuous spray of alkali liquor. An excess of this liquor is maintained in the digestion vessel and is continuously recirculated through an oxygenation loop to increase the oxygen content in the liquor to its maximum amount. The alkali liquor may be the same alkali materials as those mentioned above. The material to be delignified is retained in the digestion vessel for between 30 and 360 minutes. Alkali liquor is recycled countercurrently to the direction of flow of the defibrated material with concentrated make-up liquor being continuously added to the digestion stage while spent liquor is being continuously removed.

At the end of the digestion stage, an in digester pressing extraction device separates excess liquor from the pulped material. The pulp, having between a 15 and 25 percent solids content, can drop to a cold blow region directly below the extraction device, and may be diluted with liquor recycled from the subsequent wash stage. The pulp can be discharged from the digestion vessel with a standard cold blow wiper discharging device. It is then washed, screened, and cleaned and can be used as bleachable or unbleached grades of pulp.

Spent liquor extracted from the digestion vessel is evaporated and is burned using well known wet air oxidation or black liquor combustion techniques for recovery of the chemicals therein. The potential use of caustic with boron compounds added thereto as the primary or partial constituents of the alkali liquor has been shown to eliminate the need for any recausticization step in the recovery process because of the autocausticizing nature of the boron compounds. See Janson, "The Use of Unconventional Alkali in Cooking and Bleaching", Part I, *Paperi japuu*, No. 6–7, 1977, pp. 425–430.

Accordingly, it is an object of this invention to obtain a substantial yield of high quality pulp in an oxygen delignification process by maintaining a low consistency of defibrated material throughout the delignification stage and by continuous recycling of the major portion of the alkali liquor through this stage.

These and other objects and advantages of the invention will be apparent to those skilled in the art from the description of the invention given herein.

DESCRIPTION OF THE PREFERRED EMBODIMENTS

Figure 1:
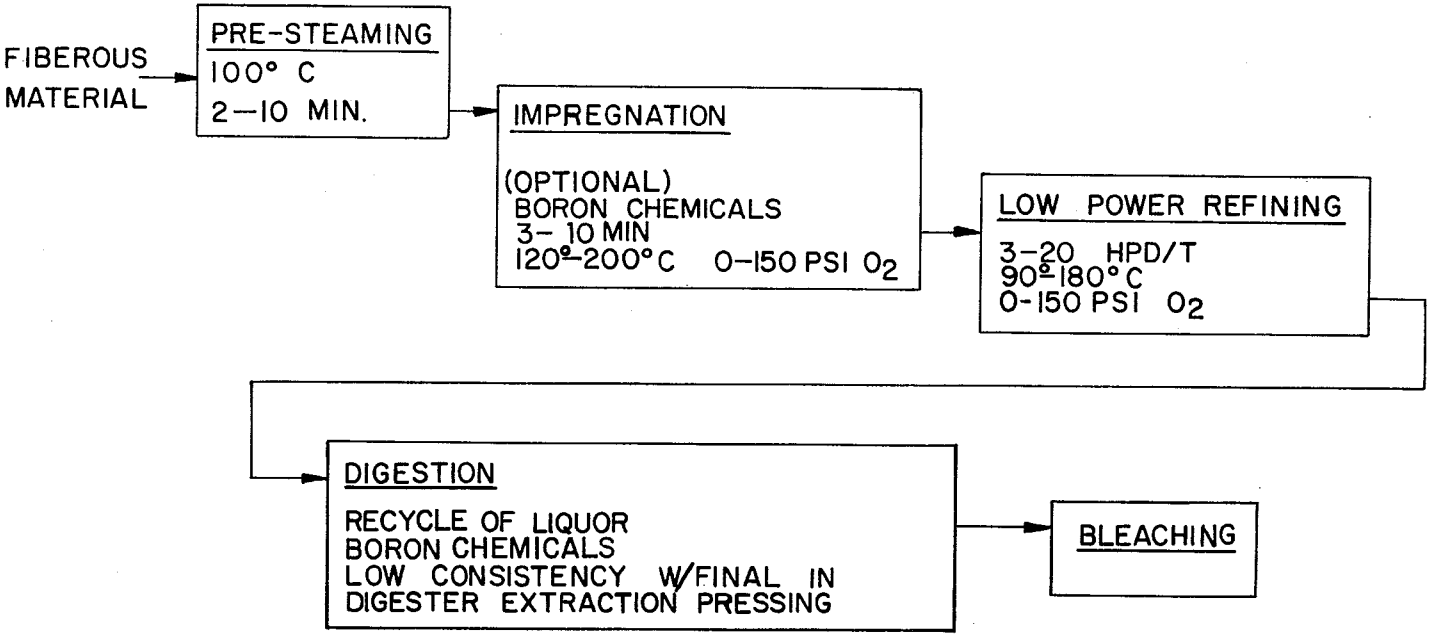
FIG. 1 is a flow diagram illustrating the series of steps to be followed in the practice of the invention.

Referring to FIG. 1 which shows a flow diagram of the process of the present invention, coarse fibrous material such as wood chips or other untreated fibrous agricultural material is subjected to a pre-steaming step to soften the fibrous material. This pre-steaming step is carried out at about 100° C. in the presence of steam for about 2 to 10 minutes depending on the degree of softening desired. The fibrous material is then optionally passed to an impregnation vessel where it is mixed with an alkali liquor that contains boron compounds. Examples of boron containing compounds which may be used in the impregnation step of the process are $Na_3BO_3$, $H_3BO_3$, $Na_2B_4O_7.10H_2O$, $Na_2HBO_3.NaOH$, $NaH_2BO_3.NaOH$ and $Na_2B_4O_7.5H_2O$. The pH of this alkali liquor is adjusted to a range of between 8.0 and 13.0 with the concentration of alkali being from 3 to 150 percent by weight based on the initial dry weight of the fibrous material charge. The temperature in the impregnation vessel is maintained at from 90° to 200° C. for a treatment time of from 3 to 10 minutes depending on the type of fibrous material being treated. Oxygen may optionally be present during the impregnation stage at a pressure of from 1 to 150psi partial $O_2$ pressure. The impregnation step is carried out for a time sufficient for the alkali liquor to penetrate and soften the fibrous material, but insufficient for any significant delignification to occur.

After impregnation, the fibrous material is transferred to the defiberization or refining stage of the process. Defiberization is accomplished by using either a single or double disc pressurized refiner or other suitable apparatus. Only the minimum power necessary for defiberization is used at this stage of the process to minimize fiber damage. When a high consistency refiner is used for this stage of the process, power usage should be between 3 and 20 HPD/T (horsepower days per ton). Temperatures in the low-power refining stage of the process are maintained at from 90° to 180° C. and pressures of from 1 to 150 psi are utilized. Oxygen gas may be present during the refining stage making up part or all of the gas present at the particular pressure used.

Figure 2:
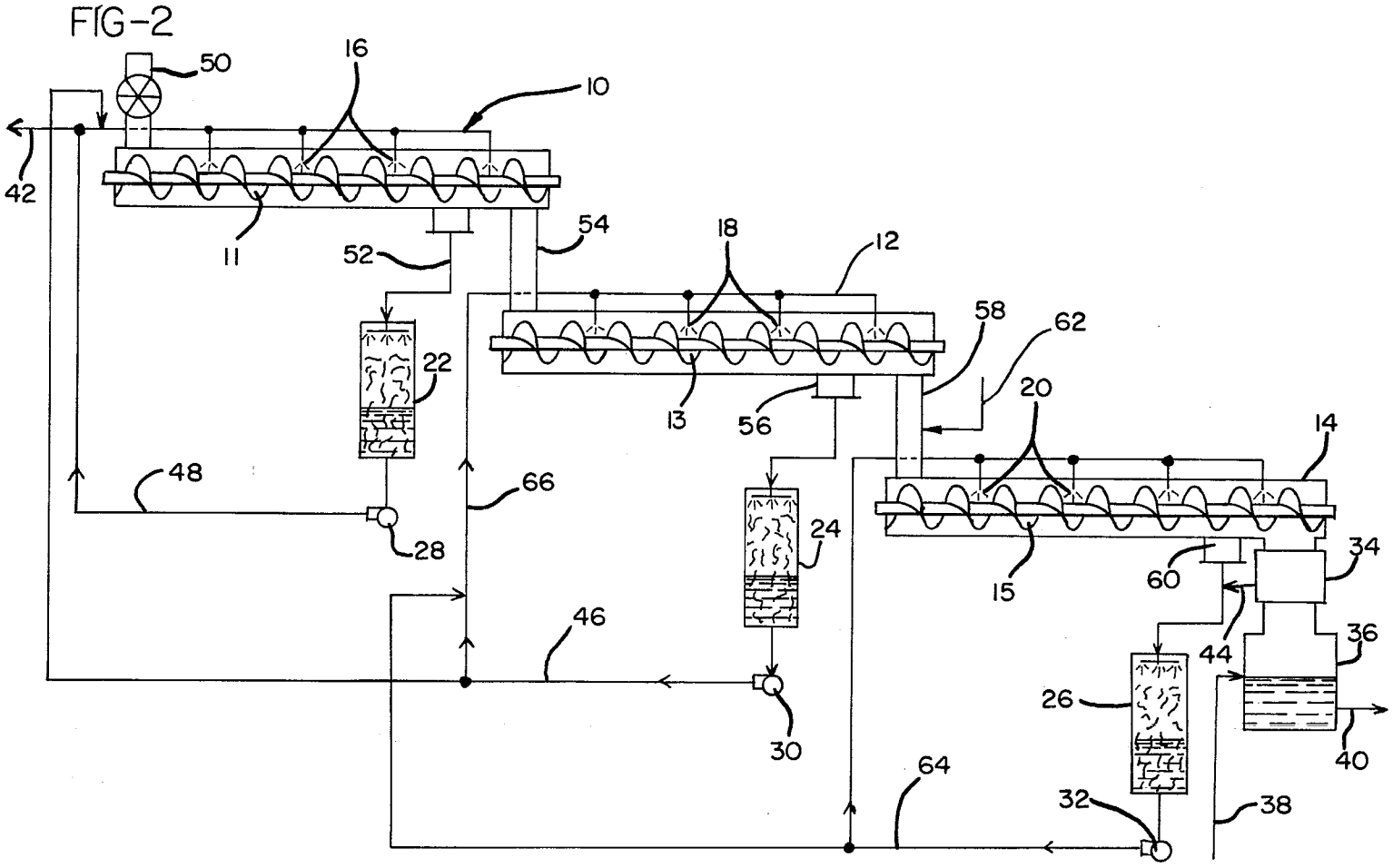
FIG. 2 is a schematic diagram of the digestion stage of the process illustrating the directions of flow of the defibrated material and alkali liquor through the digestion vessel.

After the low-power refining stage where the material has been gently defibered, the material passes next to the digestion or delignification stage of the process. The digestion stage of this process may be better understood by reference to FIG. 2 which illustrates schematically the countercurrent flow of recycled alkali liquor through this stage of the process. Pulp from the refining stage having a 20 to 30 percent solids content is admitted to tube 10 through inlet 50. All of the tubes in the digestion stage of the process are maintained at 120° to 180° C. at a total pressure of between 50 and 275 psi oxygen gas. The pulp is immediately reduced to a solids content of between 3 and 8 percent by excess alkali liquor sprayed from nozzles 16. This low consistency of pulp is maintained throughout the digestion stage of the process by continuous recycle and addition of alkali liquor.

The alkali liquor is made up of boron containing compounds and their salts, such as $Na_2B_4O_7.10H_2O$, $Na_2B_4O_7.5H_2O$, and $Na_3BO_3$. The alkali materials are present at concentrations of from 0.01 to 2.0 molar and the alkali is present in quantities of from 20 to 150 percent by weight of the initial dry fibrous material. Total retention time in the digester stage for a given charge of material is from 30 to 360 minutes.

The pulp is transported successively through tubes 10, 12, and 14 by timing screw conveyors 11, 13, and 15, respectively. After exiting from final tube 14, the pulp, still at a low consistency of 3 to 8 percent solids content, is passed through an in digester dewatering device 34 which may be a pressing extraction type device well known in the art. This dewatering step serves to extract excess alkali liquor from the pulp. The pulp, now at 15–20 percent solids content, passes directly to a cold blow region 36 where it is contacted with wash liquor 38 recycled from a subsequent washing stage. The pulp is discharged to the washing stage through line 40 with a conventional blow wiper discharger.

Make-up alkali liquor is added to tube 14 at inlet 62. Excess liquor exits tube 14 at outlet 60 and is taken to oxygenation chamber 26. Additional excess liquor recovered from dewatering device 34 is also recycled through line 44 to oxygenation chamber 26. The oxygenation chambers 22, 24, and 26 all consist of vessels which may contain glass or stainless steel Raschig rings, beads, spheres, or Beryl saddles. In these chambers, the alkali liquor is sprayed over the Raschig rings or other contacting means and, as it flows downwardly over the contacting bed, oxygen containing gas is passed counter-currently through the bed and the oxygen content of the partially spent liquor is increased to its maximum extent.

After oxygenation in chamber 26, some of the excess liquor from tube 14 and dewatering device 34 is pumped by pump 32 back to spray nozzles 20 of tube 14 for recycle and some is pumped through lines 64 and 66 to spray nozzles 18 in tube 12 for recycle in that tube. In alike manner, some of the partially spent liquor from tube 12 exits at outlet 56, is oxygenated at chamber 24, and is pumped by pump 30 through lines 46 and 66 back into tube 12 while the remainder is pumped to spray nozzles 16 in tube 10. Again, in a like manner, some of the partially spent liquor from tube 10 exits at outlet 52, is oxygenated in chamber 22, and is pumped by pump 28 through line 48 to spray nozzles 16.

A portion of the liquor recycled from tube 10 is continuously withdrawn via line 42 to a recovery operation. There the spent liquor undergoes evaporation and is then burned using wet air oxidation or black liqour combustion techniques to recover the boron-containing compounds. Because of the auto-causticizing nature of the boron-containing compounds used in this invention, no recausticization step is in that instance required prior to reusing the chemicals to make up fresh liquor.

It has been found that in order to obtain homogeneously delignified pulp using an oxygen pulping process, use of high liquor to fibrous material ratios on the order to 20/1 to 30/1 are necessary. This high liquor to solids ratio assures intimate contacting of the fibrous material with the alkali pulping liquor and the dissolved oxygen contained therein. However, such high liquor to fibrous material ratios in the past have been uneconomical due to high evaporation and recovery costs. The process of this invention has solved that problem through recycling of the major portion of the spent liquor. Thus, although the consistency of the pulp in each tube of the digestion stage is only 3 to 8 percent (a liquor to fibrous material ratio of 12/1 to 30/1), the effective liquor to fibrous material ratio is actually much lower, at between 4/1 and 8/1. How this low effective ratio is arrived at can be seen by the following example.

If, for example, a pulp consistency of about 3 percent (a liquor to fibrous material ratio of about 30/1) is utilized and about 80 percent of the liquor used in the digestion vessel is recycled for a given charge of fibrous material, then only about 20 percent or one-fifth of the liquor used in the digestion vessel must be freshly added per charge of fibrous material. However, this small amount of fresh liquor contains the same total amount (by weight) of alkali material as did the original charge of liquor, making it much more concentrated than the original charge of liquor. Thus, although the liquor to fibrous material ratio in the digestion vessel is actually maintained at a 30/1 ratio, only about one-fifth of that liquor is newly added make-up liquor. Therefore, the effective liquor to fibrous material ratio for a given charge of material is only one-fifth of 30/1 or about a 6/1 liquor to fibrous material ratio. Such a liquor to solids ratio enables much lower evaporation and recovery costs resulting in an economical recovery operation.

The countercurrent flow of the major portion of the recycled liquor through the digestion stage also serves to increase the delignification rate of the process. This increased delignification rate may be due in large part to the build-up of the concentration of the alkaline chemical compounds in the liquor which results from recycling. Addition of concentrated fresh make-up liquor to the digestion vessel gradually builds up the concentration of the alkaline chemicals in the pulping liquor with resultant faster delignification rates. This is especially true where borate compounds are utilized as the alkaline chemical.

It has been found that an initial borate dosage of 60 percent by weight based on the initial dry weight of the fibrous material with recycle of 80 percent of the liquor used for each 90 minute pulping and addition of make-up liquor at the same 60 percent borate level enables production of a bright (about 55 GE) pulp with acceptable strength levels as well as a spent liquor with a high solids content enabling economical recovery.

The following examples are given by way of illustration only, and the scope of this invention is not to be limited by these examples.

EXAMPLE I

Pine chips were pre-steamed for approximately 3 minutes at 45 psi to soften them and remove any trapped air. They were then refined at 45 psi in a 36 inch Bauer refiner with a power input of 16.6 HPD/T. No impregnation step was used. The defiberized material was then delignified in a laboratory digester at a liquor to wood ratio of 30 to 1 for 90 minutes at 160° C. and a partial oxygen pressure of 140 psi. The pulping liquor was made up from borate compounds at a dosage of about 60 percent by weight based on the initial dry weight of the pine chips. The results were as follows:

Yield of pulp: 49.1%
Kappa number: 8.9
Freeness: 600 CSF
Break length: 8.6 Km.
Tear factor: 88
Burst factor: 49
Brightness: 55.0%

EXAMPLE II

Pine chips were oxygen pulped as in Example I except that about 80 percent of the alkali liquor used in Example I was recycled, after being reoxygenated, to the digestion vessel with only about 20 percent fresh make-up alkali liquor (borate compounds at 60 percent dosage by weight based on the initial dry weight of the pine chips). The results were as follows:

Yield of pulp: 48.8%
Kappa number: 6.7
Freeness: 600 CSF
Break length: 8.8 Km.
Tear factor: 70
Burst factor: 44
Brightness: 52.0%

EXAMPLE III

Pine chips were oxygen pulped as in Example II, again recycling about 80 percent of the alkali liquor used in the previous Example with only about 20 percent fresh make-up liquor. The results were as follows:

Yield of pulp: 50.7%
Kappa number: 5.4
Freeness: 600 CSF
Break length: 8.5 Km.
Tear factor: 73
Burst factor: 44
Brightness: 51.0%

EXAMPLE IV

As in Examples II and III, about 80 percent of the alkali liquor was recycled to the digestion vessel during pulping of a new charge of pine chips. The results were as follows:

Yield of pulp: 48.6%
Kappa number: 7.3
Freeness: 600 CSF
Break length: 8.3 Km.
Tear factor: 85
Burst factor: 44
Brightness: 50.5%

As can be seen from the above examples, pulps of substantially the same yield, strength, and brightness are produced by recycling a major portion of the alkali liquor in the digestion vessel as are produced when using fresh alkali liquor. Surprisingly, the Kappa numbers of pulps produced using recycled liquor were lower than the Kappa number of the pulp of Example I. Such lower Kappa numbers indicate a faster rate of delignification when using recycled liquor while maintaining substantially the same strength and brightness characteristics of the pulp. After the fourth run, the borate recycle system had assumed essentially steady state operation.

EXAMPLE V

Pine chips were processed as in the previous examples except that the alkali pulping liquor was a sodium carbonate solution at a dosage of about 30 percent by weight based on the initial dry weight of the pine chips. Runs 2–5 utilized about 80 percent recycled liquor from the previous respective runs with only about 20 percent fresh liquor being added to the digestion vessel. The results were as follows:

| | Run 1 | Run 2 | Run 3 | Run 4 | Run 5 |
|---|---|---|---|---|---|
| Yield of pulp | 51.0% | 48.9% | 53.0% | 52.9% | 66.1% |
| Kappa number | 24.4 | 13.9 | 13.8 | 35.6 | 75.0 |
| Freeness | 600 CSF | 600 CSF | 600 CSF | 600 CSF | 600 CSF |
| Break length | 7.8 Km | 7.9 Km | 8.0 Km | 7.8 Km | 6.4 Km |
| Tear factor | 70 | 70 | 68 | 78 | 74 |
| Burst factor | 41 | 36 | 43 | 40 | 30 |
| Brightness | 33% | 36% | 38% | 28% | 24% |

As can be seen, after the third run using recycled liquor, the Kappa numbers rise drastically indicating a poorly delignified pulp when compared to the much lower Kappa numbers achieved using recycled borate liquor. This demonstrates the unexpected superiority of the use of boron containing compounds in a low consistency oxygen delignification process using recycled liquor.

While the methods and apparatus herein described constitute preferred embodiments of the invention, it is to be understood that the invention is not limited to these precise methods and apparatus, and that changes may be made in either without departing from the scope of the invention, which is defined in the appended claims.

What is claimed is:

1. A process for the oxygen delignification of wood chips comprising the steps of:

subjecting the wood chips to steam for a time sufficient to form a softened fibrous material, refining said softened fibrous material to form a refined material, delignifying said refined material at a consistency of about 3 to about 8% solids content in the presence of oxygen and an alkali liquor containing sodium tetraborate in a plurality of stages in which a major portion of partially spent alkali liquor from each stage is recycled to the next preceding deliqnification stage.

2. The process of claim 1 including the step of impregnating said softened fibrous material with an alkali material containing sodium tetraborate prior to said refining step.

3. The process of claim 2, where the partially spent alkali liquor is reoxygenated prior to being recycled.

4. The process of claim 3, where fresh alkali liquor containing said alkali materials is continuously added to the final delignification stage and spent alkali liquor is continuously withdrawn from the first delignification stage.

5. The process of claims 2 or 1 wherein said alkali material is at a dosage of from about 3 to about 150 percent by weight of the boron-containing compound based on the initial dry weight of said wood chips.

6. The process of claim 5, where the alkali liquor comprises an aqueous solution of said alkali materials compounds at a dosage of 60 percent by weight based on the initial dry weight of said wood chips.

7. The process of claim 6, where the impregnation step is carried out at from 90° to 200° C. for 3 to 10 minutes.

8. The process of claim 7, where the delignification step is carried out at 120° to 180° C. at a total oxygen pressure of 50 to 275 psi.

9. The process of claim 1 in which said delignification step includes in digester spraying of recycled alkali liquor over the delignified material.

10. The process of claim 1, including the additional step of in digester dewatering of the delignified material as the last stage of the delignification step.

* * * * *